US008568162B1

(12) United States Patent
White et al.

(10) Patent No.: US 8,568,162 B1
(45) Date of Patent: Oct. 29, 2013

(54) MOUNTABLE LOUDSPEAKER ASSEMBLIES AND CLAMPS

(75) Inventors: Timothy John White, Round Rock, TX (US); Brett A. Triola, Houston, TX (US); Lawrence C. Kiliszewski, The Woodlands, TX (US)

(73) Assignee: Wet Sounds, Inc., Houston, TX (US)

( * ) Notice: Subject to any disclaimer, the term of this patent is extended or adjusted under 35 U.S.C. 154(b) by 154 days.

(21) Appl. No.: 13/108,376

(22) Filed: May 16, 2011

(51) Int. Cl.
*H01R 13/66* (2006.01)

(52) U.S. Cl.
USPC ..... 439/574

(58) Field of Classification Search
USPC ..... 439/577, 55, 571–573, 578–584, 439/595–603
See application file for complete search history.

(56) References Cited

U.S. PATENT DOCUMENTS 3,260,375 A * 7/1966 Lemelson ..... 414/728
3,272,347 A * 9/1966 Lemelson ..... 414/728
6,002,780 A * 12/1999 Espiritu ..... 381/182
6,374,942 B1 4/2002 Huggins
6,798,892 B2 9/2004 Parnell
2005/0237218 A1 10/2005 Tang et al.

* cited by examiner

*Primary Examiner* — Jean F Duverne
(74) *Attorney, Agent, or Firm* — Mollie E. Lettang; Daffer McDaniel LLP

(57) ABSTRACT

Loudspeaker clamps and assemblies are disclosed which include base and mounting clamps having respectively engageable electrical connectors, wherein the electrical connectors include distinct electrical contacts for audio signal transmission, ground connection, and optionally light signal transmission. In some cases, the structure of the base clamp may be rotatable relative to the structure of the mounting clamp when the electrical connectors are engaged. In some embodiments, the base and mounting clamps may each include an annular structure surrounding their respective electrical connectors, wherein one of the annular structures is nestable within the other encircling structure and the nestable structure includes an outer circumferential groove. Such embodiments of clamps and assemblies further include a fork having two prongs which are dimensionally configured to slide through first and second through holes of the encircling structure and into opposing sides of the outer circumferential groove when the base and mounting clamps are engaged.

20 Claims, 4 Drawing Sheets

MOUNTABLE LOUDSPEAKER ASSEMBLIES AND CLAMPS

BACKGROUND OF THE INVENTION

1. Field of the Invention

This invention generally relates to assemblies and clamps for mounting and/or suspending objects, and more specifically to mountable loudspeaker assemblies and clamps.

2. Description of the Related Art

The following descriptions and examples are not admitted to be prior art by virtue of their inclusion within this section.

Clamps used to mount and/or suspend objects are often specifically designed for the application in which they are used since different applications and environments present different needs and challenges. For example, clamps and assemblies used for mounting loudspeakers on wakeboard towers may be made of materials specifically designed for aquatic environments and have characteristics different than clamps used for mounting objects on or in a wall. In particular, some loudspeaker wakeboard tower clamps and assemblies are configured such that a loudspeaker may be rotated in its mounted position in order to quickly change its direction of sound propagation. In addition, some loudspeaker wakeboard tower clamps and clamp assemblies include electrical contacts for connecting audio signal and ground wires of the speaker to audio signal and ground wires provided in the tower such that the wires are not exposed. In some cases, loudspeaker wakeboard tower clamps and clamp assemblies may include a quick disconnect screw such that a loudspeaker may be removed quickly and easily.

Although any one or more of such features are generally desirable, current design configurations of loudspeaker wakeboard tower clamps and clamp assemblies implementing such features are limited in application and/or pose safety concerns. For instance, loudspeaker wakeboard tower clamps and clamp assemblies having only a quick disconnect screw to secure a loudspeaker in its mounted position put the loudspeaker at risk of falling when the screw is loosened or removed, potentially causing injury or damage. Furthermore, in order to provide rotation to a loudspeaker in its mounted position, electrical contacts in loudspeaker wakeboard tower clamps and clamp assemblies are often disposed on a single electrical jack. As a consequence, the amount of power which may be provided to a loudspeaker is limited in such configurations. Moreover, the high desirability for rotational capability in loudspeaker wakeboard tower clamps and clamp assemblies has generally impeded the incorporation of electrical contacts for light signal transmission in loudspeaker wakeboard tower clamps and clamp assemblies. A reason for such a lack of development is the challenge of preventing the multitude of wires associated with having both audio and light signal transmission from twisting in the loudspeaker and/or wakeboard tower in light of the rotational functionality. As a result, loudspeakers having audio and light capability generally have light signal transmission wires connected to them independent of the loudspeaker wakeboard tower clamps used to mount and/or suspend them.

Accordingly, it would be beneficial to develop clamps and clamp assemblies for mounting and/or suspending objects, particularly loudspeakers and more specifically, loudspeakers upon wakeboard towers, which provide a quick disconnect feature, but lessen the risk of an object falling relative to conventional clamps. In addition, it would be advantageous to develop clamps and clamp assemblies offering the capability for a loudspeaker to rotate but that are not as limited in the amount of power which may be supplied to the loudspeaker as compared to conventional clamps. Furthermore, it would be desirable to develop clamps and clamp assemblies which allow a loudspeaker to rotate but are further configured to connect audio signal, light signal and ground wires of a loudspeaker to respective wires provided in a mounting structure such that the wires are not exposed.

SUMMARY OF THE INVENTION

The following description of various embodiments of mountable loudspeaker assemblies and clamps is not to be construed in any way as limiting the subject matter of the appended claims.

The clamps disclosed herein include a base clamp and a mounting clamp. The assemblies disclosed herein include a loudspeaker and any of the disclosed clamps. Some clamps include a means for securing the base clamp to a loudspeaker. In other embodiments, the base clamp may be integral with a loudspeaker. In either case, the base clamp includes a first electrical connector and the mounting clamp includes a second electrical connector engageable with the first electrical connector. In embodiments of the assemblies, the first electrical connector of the base clamp is in electrical communication with signal transmission wires of the loudspeaker. In some cases, the base clamp and the mounting clamp may each include a plurality of electrical connectors. For example, the base clamp and the mounting clamp may each include an electrical connector for audio signal transmission and a second electrical connector for ground connection. In some embodiments, the base clamp and the mounting clamp may each additionally include one or more electrical connectors for light signal transmission.

In some cases, the base clamp may include a first plurality of electrical connectors in electrical communication with signal transmission wires of the loudspeaker and further a first clamp structure surrounding the first plurality of electrical connectors which is coupled to the loudspeaker. Additionally in such embodiments, the mounting clamp may include a second plurality of electrical connectors engageable with the first plurality of electrical connectors and a second clamp structure surrounding the second plurality of electrical connectors. In such cases, either the first plurality of electrical connectors or the second plurality of electrical connectors are electrical pins and the other of the first and second plurality of electrical connectors are electrical pin receptacles configured for receiving the electrical pins. Additionally in such cases, the first clamp structure is rotatable relative to the second clamp structure when the first and second pluralities of electrical connectors are engaged.

Other embodiments of the clamps and assemblies disclosed herein may additionally or alternatively have the base clamp and the mounting clamp each include an annular structure surrounding respective first and second electrical connectors of the base and mounting clamps. In such cases, one of the annular structures is nestable within the other encircling annular structure and the nestable annular structure includes an outer circumferential groove. Such embodiments of the clamps and assemblies may further include a fork having two prongs and the encircling annular structure may include first and second through holes configured to respectively receive the two prongs. In such cases, the two prongs are dimensionally configured to slide through the first and second through holes and into opposing sides of the outer circumferential groove when the base clamp and the mounting clamp are engaged.

BRIEF DESCRIPTION OF THE DRAWINGS

Other objects and advantages of the invention will become apparent upon reading the following detailed description and upon reference to the accompanying drawings in which.

Figure 1:
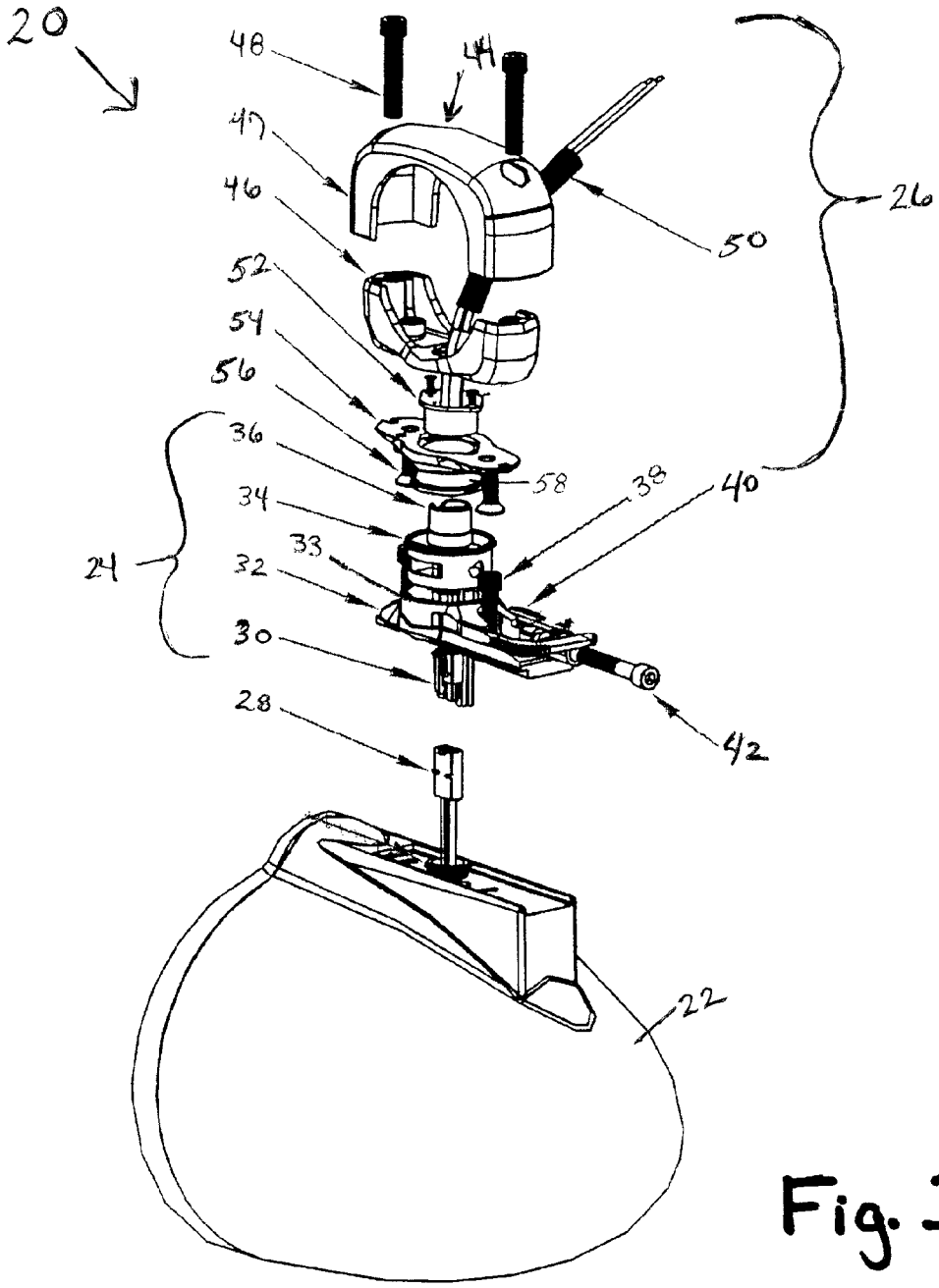
FIG. 1 is an exploded view drawing of a loudspeaker and clamp assembly.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Turning to the drawings, exemplary embodiments of mountable loudspeaker assemblies and clamps as well as detailed depictions of components thereof are provided. In particular, FIG. 1 depicts an exploded view drawing of assembly 20 having loudspeaker 22, base clamp 24 and mounting clamp 26. Various configurations of loudspeaker 22, base clamp 24 and mounting clamp 26 are described below and, thus, the clamps and assemblies provided herein are not necessary limited to the depiction of components shown in FIG. 1. Furthermore, the base clamps and mounting clamps disclosed herein are not limited to the examples depicted in FIGS. 2-12. Additionally, it is noted that the drawings are not necessarily drawn to scale. In particular, some features may be drawn to a larger scale than other features to emphasize their characteristics.

In general, loudspeaker 22 may include any type of loudspeaker, including those configured for all-purpose use and those configured for specific applications. As will be set forth in more detail below, the clamps and assemblies described herein may be particularly applicable to mounting loudspeakers on boats and, more particularly, on wakeboard towers. Thus, loudspeaker 22, in some embodiments, may be particularly configured for an outdoor aquatic environment, such as but not limited to being made of corrosion resistant materials and/or having acoustics specifically designed for propagating sound in an open environment. It is noted that although the description of the assemblies and clamps provided herein emphasize applications for suspending and/or mounting loudspeakers, the applications of the assemblies and clamps are not necessarily so limited. In particular, the clamps and assemblies described herein may be used to suspend and/or mount various objects having signal transmission wires to connect to a power source. In addition, it is contemplated that some features of the clamps and assemblies disclosed herein may be used for suspending and/or mounting objects which do not include signal transmission wires. For example, the configuration of the clamps and assemblies described below to include an outer circumferential groove on one of the base and mounting clamps and an engaging fork may be used in variety of clamp configurations. Thus, loudspeaker 22 in assembly 20 of FIG. 1 may, in some cases, be replaced with another object.

The term loudspeaker as used herein refers to a device that converts electric signals to audible sound and, thus, loudspeaker 22 includes signal transmission wires which conclude at electrical port 28. The term loudspeaker may be interchangeably used herein with the term speaker. In addition to including audio signal transmission wires, loudspeaker 22 may, in some embodiments, include light signal transmission wire/s connected to one or more light components integrated within the loudspeaker. The integrated light components may be any type of light source, such as but not limited to light emitting diodes. As will be set forth in more detail below, light signal transmission wire/s in loudspeaker 22 may, in some cases, conclude at electrical port 28 with the audio signal transmission wires of the loudspeaker. Coupling such a configuration with a clamp equipped to transmit light signals will allow power to be supplied to the light components of a loudspeaker through the clamp rather than exterior to and independent of the clamp.

As shown in FIG. 1, base clamp 24 includes electrical port 30 coupled to the underside of structure 32. Electrical port 30 is connected to one or more electrical connectors disposed within structure 32 and is configured for engagement with port 28 of loudspeaker 22. The term electrical connector as used herein refers to a component configured to engage with a component of counterpart configuration to transmit electrical signals between devices. In particular, the term electrical connector may encompass electrical ports (male and female configurations), electrical pins, electrical pin receptacles, electrical jacks, and electrical jack receptacles. The term electrical port as used herein refers an electrical connector having an array of electrical contacts each of which is coupled to a distinct signal wire of a device. The term electrical pin as used herein refers to a small slender rod in which a majority portion, nearly all, or an entirety is conductive. The term electrical pin receptacle as used herein refers to a cylindrical receptacle which is dimensionally configured to receive an electrical pin such that the outer surface of the electrical pin contacts the inner surface of the electrical pin receptacle and has an inner surface with a majority portion, nearly all, or an entirety which is conductive. An engaging pair of electrical pins and electrical pin receptacles is generally used to pass a single signal type, such as an audio signal or ground.

The term electrical jack as used herein refers small slender rod having one or more electrically conductive and isolated contacts disposed along its column each of which is used to pass a single type of signal. The term electrical jack receptacle as used herein refers to a cylindrical receptacle having one or more electrically conductive and isolated contacts disposed along its interior surface and which is dimensionally configured to receive an electrical jack such that the outer surface of the electrically conductive and isolated contacts along the electrical jack contact respective electrically conductive and isolated contacts in the receptacle. Due to the electrical contacts of an electrical jack and an electrical jack receptacles being isolated, proper alignment among the contacts is needed for signal transfer. Since electrical jacks and electrical jack receptacles may include more than electrically conductive contact, engageable electrical jacks and electrical jack receptacles may be used to transfer different types of signals.

As shown in FIG. 1, base clamp 24 may include bushing 34 and plug 36 configured for placement within annular structure 33 of structure 32. In general, the configurations of structure 32, annular structure 33, bushing 34 and plug 36 may vary depending on the design specifications of the clamp and/or assembly. Some example configurations of structure 32, annular structure 33, bushing 34 and plug 36 are set forth below in reference to FIGS. 2-6 and 12, but the clamps and assemblies described herein are not necessarily so limited. In fact, in some embodiments, bushing 34 and/or plug 36 may be omitted from base clamp 24. In any case, the clamps and assemblies described herein may, in some embodiments, include a fastener for affixing a base clamp to an object to be suspended and/or mounted and, in specific embodiments, a fastener for affixing a base clamp to a loudspeaker. In general, any type of fastener may be used which is applicable for the design specifications of the base clamp and the object to be suspended and/or mounted. Examples of fasteners include but are not limited to bolts, screws, and clamps. FIG. 1 illustrates the use of screws 38 for affixing structure 32 of base clamp 24 to loudspeaker 22 as an example. The fastener may be considered part of the base clamp or may be considered independent of the base clamp. In other embodiments, a base clamp may be integral to an object to be suspended and/or mounted and, thus, a distinct fastener for their union may be omitted from the clamps and assemblies described herein. In such cases, electrical portions 28 and 30 may also be omitted and, thus, the signal transmission wires of loudspeaker may, in some cases, be coupled directly to the electrical connectors disposed within structure 32 of base clamp 24.

Regardless of whether a base clamp is affixed or is integral to an object to be suspended and/or mounted, the clamps and assemblies described herein include one or more fasteners for joining the base clamp to a mounting clamp. The fastener/s may be considered part of the base clamp, part of the mounting clamp or independent of the base and mounting clamp components. As with the fasteners discussed for affixing a base clamp to an object to be suspended and/or mounted, any type of fastener which is applicable for the design specifications of a base clamp and a mounting clamp may be used to join a base clamp to a mounting clamp. Examples of fasteners include but are not limited to bolts, screws, forks and clamps. Examples of two fasteners which may be collectively used to join base clamp 24 to mounting clamp 26 in assembly 20 include fork 40 and locking screw 42 as shown in FIG. 1. Details of fork 40 and locking screw 42 as well as the configurations of base clamp 24 and mounting clamp 26 to receive such fasters are described in more detail below in reference to FIGS. 2-12. As noted below, the configurations of fork 40 and locking screw 42 offer a quick disconnect feature for the clamps and assemblies disclosed herein and also allow an object to rotate while suspended, but lessen the risk of the object falling relative to conventional clamps having one or more of such features. As noted above, the clamps and assemblies disclosed herein may include any type of fastener for joining a base clamp to a mounting clamp and, thus, in some embodiments, fork 40 and/or locking screw 42 may be omitted from assembly 20.

Turning to the depiction of mounting clamp 26 in FIG. 1, it is shown that the mounting clamp may include a plurality of components, particularly components for a tubular mounting unit and a detachable mounting plate in which a plug including one or more electrical connectors is to be disposed. More specifically, mounting clamp 26 is shown including tubular mounting unit 44 having lower clamp portion 46, upper clamp portion 47 and screws 48 for fastening upper clamp portion 47 to lower clamp portion 46. As shown in FIG. 1, lower clamp portion 46 and upper clamp portion 47 are configured to surround a cylindrical object when joined and, thus, tubular mounting unit 44 may generally be used to mount loudspeaker 22 to a cylindrical support structure, such as but not limited to a wakeboard tower, a dune buggy carriage, or a golf cart. As shown in FIG. 1, lower clamp portion 46 includes a hole through which wires 50 are routed. Wires 50 are coupled to plug 52, which surrounds and/or supports one or more electrical connectors. The one or more electrical connectors are engageable with the one or more electrical connectors disposed within plug 36 of base clamp 24. Although not shown in FIG. 1, wires 50 may terminate at an electrical port, similar but not limited to electrical ports 28 and 30, such that they may be connected to wires disposed within a cylindrical support to which tubular mounting unit 44 is fastened. The wires in the cylindrical support may generally be coupled to a power source for providing audio signals and, in some embodiments, power for illumination components.

As noted above and shown in FIG. 1, mounting clamp 26 may include detachable mounting plate 54. In general, detachable mounting plate 54 may include a substantially flat surface, a fastener for affixing the substantially flat surface against a support structure and an opening for plug 52 to be disposed. In general, any type of fastener may be used, including but not limited to screws, bolts or clamps. As shown in FIG. 1, mounting clamp 26 may include screws 56 (or any other type of fastener) to affix detachable mounting plate 54 to lower clamp portion 46 of tubular mounting unit 44. In this manner, mounting clamp 26 offers two mounting capabilities, specifically being able to mount to a cylindrical support via tubular mounting unit 44 as well as to support structures of other geometries (particularly flat surfaces) via detachable mounting plate 54. Some example configurations of detachable mounting plate 54 and accommodating configurations of lower clamp portion 46 are set forth below in reference to FIGS. 9 and 10. It is noted, however, the clamps and assemblies described herein are not necessarily limited to the depictions of FIGS. 9 and 10. In particular, mounting clamp 26 may not, in some embodiments, include a detachable mounting plate. Rather, mounting plate 54 may be integral with tubular mounting unit 44 or, conversely, tubular mounting unit 44 may be omitted from assembly 20. In either case, mounting plate 54 includes an annular structure 58 which is engageable with annular structure 33 of base clamp 24. Specific configurations of annular structures 33 and 58 are described in more detail below in reference to FIGS. 2-12.

Figure 2:
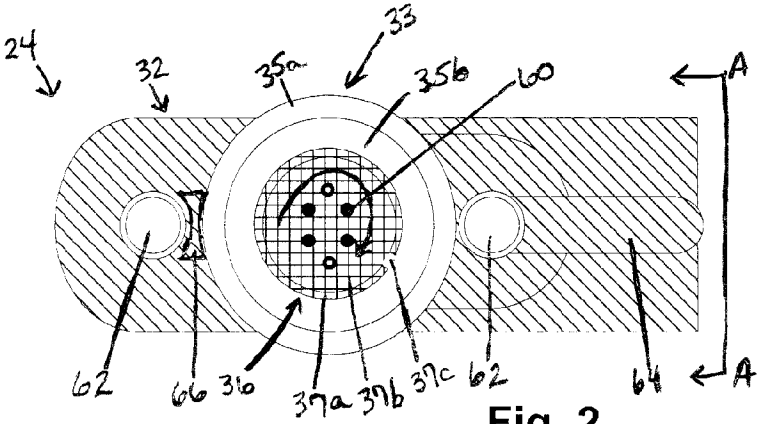
FIG. 2 is top view drawing of a base clamp for the loudspeaker and clamp assembly depicted in FIG. 1.

A top view drawing of base clamp 24 is depicted in FIG. 2. In particular, base clamp 24 is shown with annular structure 33, screw holes 62 and recessed valley 64 arranged within structure 32. Annular structure 33 comprises annular wall **35*a* and recessed inner portion 35*b*. In embodiments in which base clamp 24 includes bushing 34, bushing 34 may be configured to line annular structure 33 and, thus, may be disposed along annular wall 35*a* as well as the floor of recessed inner portion 35***b*. As noted above, annular structures 33 and 58 respectively of base clamp 24 and mounting claim 26 are configured for engagement. In the configuration set forth in FIG. 2, annular structure 33 may be configured to encircle annular structure 58 and, thus, may have a larger inner diameter than the outer diameter of annular structure 58. Furthermore, annular structures 33 and 58 may be fully or nearly fully engageable and, thus, their wall heights may be similar. Screw holes 62 may be used to affix base clamp 24 to an object, such as loudspeaker 22. As noted above, the means by which to fasten a base clamp to an object for the clamps and assemblies disclosed herein may vary depending on the design specifications of the base clamp and the object. Thus, the placement of screw holes 62 may vary across structure 32 or may be omitted in some embodiments if a non-screw type fastener is used. As will be set forth in more detail below, recessed valley 64 may be advantageous in cases in which the clamps and assemblies disclosed herein include a fork and a locking screw for securing base clamp 24 to mounting clamp 26. Such a configuration, however, is not a necessity and, thus, recessed valley 64 may be omitted from base clamp 24 in some embodiments.

FIG. 2 further shows base clamp 24 including plug 36 disposed within annular structure 33, surrounding and supporting a plurality of electrical pins 60. Although six electrical pins are shown in FIG. 2, the clamps and assemblies disclosed herein are not necessarily so limited. In particular, any type of electrical conductor, including electrical pins, electrical pin receptacles, electrical jacks and electrical jack receptacles, may be disposed within annular structure 33. (As noted above, the term electrical connector as used herein refers to a component configured to engage with a component of counterpart configuration to transmit electrical signals between devices and encompasses electrical pins, electrical pin receptacles, electrical jacks, and electrical jack receptacles.) In addition, any number of electrical connectors, including one or more, may be disposed within annular structure 33. Furthermore, the placement of electrical connectors within annular structure 33 may vary depending on design specifications. Thus, the clamps and assemblies disclosed herein are not restricted to the layout of electrical pins 60 shown in FIG. 2.

Six electrical pins are shown in FIG. 2 to provide an example in which an audio signal pin, a ground pin, and four pins for light signal transmission are provided in a base clamp. Multiple electrical connectors for light signal transmission may be advantageous when different types of light components or light components of different colors are included in loudspeaker 22. For example, the four pins for light signal transmission depicted in FIG. 2 may be respectively used to transmit light signals to light emitting diodes (LEDs) of different color. More or fewer electrical connectors, however, may be employed for light signal transmission in the clamps and assemblies disclosed herein. In some cases, a single electrical jack or single electrical jack receptacle may be used which include one or more conductive and isolated contacts for light signal transmission. In yet other embodiments, the clamps and assemblies considered herein may be void of electrical connectors for light signal transmission. In such cases, base clamp 24 may include two electrical connectors, one for audio signal transmission and the other for ground signal. In yet other embodiments, base clamp 24 may include a single electrical jack or electrical jack receptacle having two conductive and isolated contacts for audio signal and ground signal transmission.

As noted above, regardless of the number, placement and type of electrical connectors disposed within base clamp 24, the electrical connectors of base clamp 24 and mounting clamp 26 are engageable with each other. Thus, mounting clamp 26 may have counterpart electrical connectors to those disposed within base clamp 24, such as electrical pin receptacles when base clamp 24 includes electrical pins or vice versa. Alternatively, the electrical connectors of mounting clamp 26 may be electrical jack receptacle/s when base clamp 24 include electrical jack/s or vice versa. In addition to their electrical connectors being engageable, the plugs used to support the electrical connectors within base clamp 24 and mounting clamp 26 are engageable. As shown in FIG. 2, plug 36 of base clamp 24 may include annular barrier 37*a* and recessed inner portion 37*b*, which may be made of the same sometimes contiguous material or may be made of different materials. In such cases, the plug supporting the electrical connector/s within mounting clamp 26 may include a cylindrical support structure having an outer dimension smaller than an inner dimension of annular barrier 37*a* such that the plug is nestable within plug 36. It is noted that the plugs of base clamp 24 and mounting clamp 26 may have other configurations, including those having an opposite configuration to what is described above as well as shapes other than circular. In any case, the plugs and electrical connectors of each of base clamp 24 and mounting clamp 26 may be referenced together as an electrical connector assembly and, in some embodiments, may be particularly referenced as an assembly of the specific type of electrical connectors employed. For example, plug 36 and electrical pins 60 in base clamp 24 may be referenced together as an electrical pin assembly and the counterpart assembly in mounting clamp 26 may be referenced as an electrical pin receptacle assembly.

In some embodiments, the plugs of base clamp 24 and mounting clamp 26 may be configured with a self-alignment feature such that the correct counterpart electrical connectors may be quickly aligned for engagement. An example of such a feature is shown in FIG. 2 for base clamp 24 and in FIG. 8 for mounting clamp 26. In particular, annular barrier 37*a* of plug 36 shown in FIG. 2 may, in some embodiments, include notch 37*c* and a counterpart plug in a mounting clamp may include a protrusion (e.g., plug 52 shown in FIG. 8 may include protrusion 84 extending from cylindrical support structure 82). In general, the notch and the protrusion may be dimensionally configured to receive each other and their relative placement may coincide with counterpart electrical connectors in base clamp 24 and mounting clamp 26. In addition thereto, the tips of electrical pins 60 may be disposed below the upper surface of annular barrier 37*a*. In this manner, when base clamp 24 and mounting clamp 26 are brought together, either or both can be turned until the notch meets the protrusion and then the correct counterpart electrical connectors can engage.

As noted above, it may be advantageous in some embodiments to move/rotate loudspeaker 22 without having to fully disengage it from its mounting position. One manner in which to facilitate such rotation is for the clamp structure of base clamp 24 (e.g., structure 32 and annular structure 33) to be rotatable relative to the clamp structure of mounting clamp 26 (e.g., the structures surrounding plug 52 in FIG. 8). In embodiments when base clamp 24 and mounting clamp 26 respectively include a single electrical jack and electrical jack receptacle or vice versa, the rotation of base clamp 24 and loudspeaker 22 may be made possible by base clamp 24 and mounting clamp 26 each having their electrical connector assemblies (i.e., their electrical connectors and surrounding plugs) fixedly arranged within their respective clamp structures (i.e., the structures surrounding the electrical assemblies). In this manner, with mounting clamp 26 in a fixed position the rotation of base clamp 24 and loudspeaker 22 will cause the single electrical jack or electrical jack receptacle disposed in base clamp 24 to rotate relative to its counterpart electrical connector in mounting clamp 26. Such a configuration advantageously allows loudspeaker 22 to be moved/rotated without having to fully disengage it from its mounting position. In addition, the configuration inhibits signal wires in loudspeaker 22 and in the support structure to which mounting clamp 26 is secured from getting twisted while loudspeaker 22 is rotated.

The fixed arrangement of electrical connector assemblies within base clamp 24 and mounting clamp 26, however, will not allow rotation of base clamp 24 in embodiments in which the base and mounting clamps include multiple electrical connectors (i.e., multiple electrical pins and electrical pin receptacles or multiple electrical jacks and electrical jack receptacles) and, as such, a different configuration is needed in such embodiments to facilitate rotation of base clamp 24. One manner in which to facilitate rotation of base clamp 24 relative to mounting clamp 26 in embodiments in which multiple electrical connectors are disposed within base clamp 24 and mounting clamp 26 is to have one of the electrical connector assemblies of base clamp 24 and mounting clamp 26 rotatably arranged within its clamp structure and the other electrical connector assembly may be fixedly arranged within its clamp structure.

In particular, in embodiments in which the electrical connector assembly in base clamp 24 is rotatably arranged within structure 32 (as indicated by the rotation arrow in FIG. 2) and the electrical connector assembly in mounting clamp 26 is fixedly arranged within mounting plate 54, the electrical connector assembly in base clamp 24 may be secured into a fixed position upon engagement with the fixed electrical connector assembly in mounting clamp 26, but the rotatability of the electrical connector assembly in base clamp 24 relative to structure 32 will allow structure 32 and, thus, loudspeaker 22 to rotate. Conversely, in embodiments in which the electrical connector assembly in base clamp 24 is fixedly arranged within structure 32 and the electrical connector assembly in mounting clamp 26 is rotatably arranged within mounting plate 54, the electrical connector assembly in base clamp 24 will be allowed to rotate with the rotatable electrical connector assembly in mounting clamp 26 upon engagement of the electrical connector assemblies. Since structure 32 is fixedly attached to the electrical connector assembly in such embodiment, structure 32 and, thus, loudspeaker 22 will be allowed to rotate with the electrical connector assembly in base clamp 24.

In some embodiments, structure 32 and affixed loudspeaker 22 may be allowed to rotate freely, without any restraint on the degree or number of rotations in a given direction. Such freedom of rotation, however, may cause signal wires in loudspeaker 22 and/or in the support structure to which mounting clamp 26 is secured to get twisted while loudspeaker 22 is rotated. To avoid having the wires get twisted, base clamp 24 and mounting clamp 26 may each include a rotation stop configured to come into contact with each other when structure 32 of base clamp 24 is rotated. FIG. 2 illustrates base clamp 24 including rotation stop 66, which is a raised portion of structure 32 spaced apart from annular structure 33. Coupling such a rotation stop with a rotation stop on mounting clamp 26 will inhibit free rotation of structure 32 and, more specifically, limit it to less than 360 degrees. The configuration of rotation stop 66 depicted in FIG. 2, as an example, may limit rotation of structure 32 to approximately 350 degrees. The placement, size, and shape of rotation stop 66 of base clamp 24 and rotation stop 76 of mounting clamp 26 may vary tremendously for the clamps and assemblies disclosed herein and, thus, the depictions of rotation stop 66 in FIG. 2 and rotation stop 76 in FIGS. 7 and 8 should not restrict their configuration possibilities. In particular, rotation stops 66 and 76 may be respectively arranged adjacent to any peripheral portion of annular structures 33 and 58 and may be of any shape and size.

Figure 4:
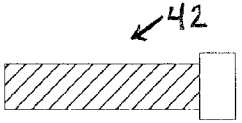
FIG. 4 is a diagram of a screw for the loudspeaker and clamp assembly depicted in FIG. 1.
Figure 3:
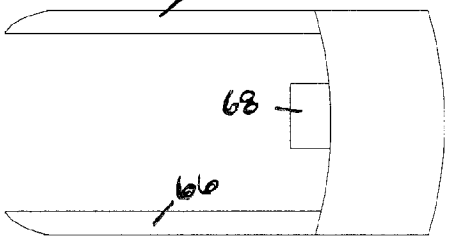
FIG. 3 is a diagram of a two-prong fork for the loudspeaker and clamp assembly depicted in FIG. 1.
Figure 5:
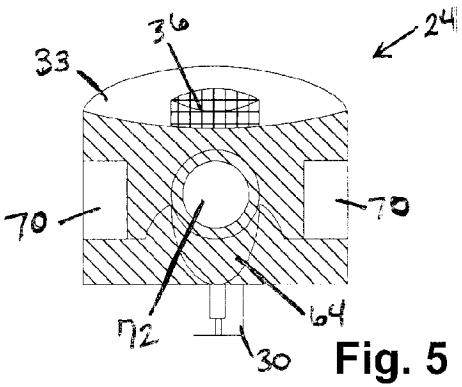
FIG. 5 is a side view drawing of the base clamp depicted in FIG. 2 taken along view AA.

As noted above, the clamps and assemblies considered herein may, in some embodiments, include a fork and a locking screw to offer a quick disconnect feature and also allow an object to rotate while suspended, but lessen the risk of the object falling relative to conventional clamps having one or more of such features. Examples of fork 40 and locking screw 42 for assembly 20 are respectively depicted in FIGS. 3 and 4. In particular, FIG. 3 shows fork 40 with prongs 66 and optional screw hole 68 disposed between the prongs and FIG. 4 illustrates an example of locking screw 42. FIG. 5 illustrates a side view drawing of base clamp 24 taken along view AA denoting first and second through holes 70 within annular structure 33 configured to respectively receive prongs 66 of fork 40. In particular, the dimensions as well as the position of first and second through holes 70 along annular structure 33 are specifically configured to receive prongs 66. As further shown in FIG. 5, annular structure 33 may include third through hole 72 for receiving locking screw 42. It is noted that although fork 40 is shown having two prongs, it is not necessarily limited to being a two-pronged fork. In particular, fork 40 may have additional prongs in between prongs 66 and/or on either side of either prong such as long as they do not interfere with the insertion of fork 40 into annular structure 33.

Figure 6:
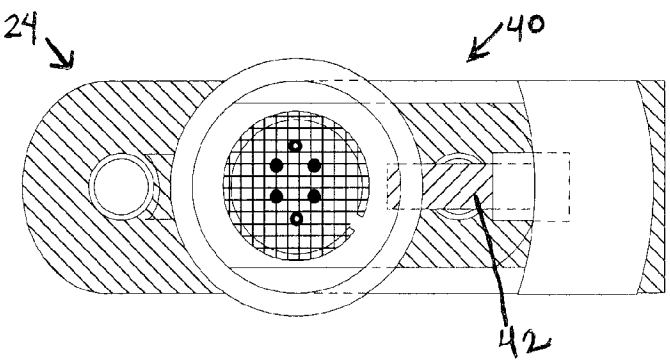
FIG. 6 is a top view drawing of the base clamp, fork and screw depicted in FIGS. 2-4 joined together.

FIG. 6 is a top view drawing of base clamp 24, fork 40 and screw 42 joined together, specifically having prongs 66 disposed within first and second through holes 70 and locking screw 42 disposed within third through hole 72. As shown in FIG. 6, prongs 66 may be dimensionally configured to slide through first and second through holes 70 of annular structure 33 and, in some embodiments, may be further dimensioned to touch an interior surface of annular structure 33 when inserted into the through holes. Regarding the latter configuration, prongs 66 may, in some embodiments, have curved chamfered ends as shown in FIG. 3 to abut an interior surface of annular structure 33. In embodiments in which base clamp includes bushing 34 lining the interior surface of annular structure 33, the bushing will include through holes in alignment with first and second through holes 70 and an additional through hole in alignment with third through hole 72 when applicable. In some cases, the bushing may include through holes on opposing sides of the bushing such that prongs 66 may abut the interior surface of annular structure 33. The through holes in the opposing side of bushing 34, however, are optional and, thus, may be omitted in some embodiments. In such cases, the chamfered ends of prongs 66 may alternatively abut the interior surface of bushing 34. In any case, the clamps and assemblies disclosed herein are not restricted to the placement of first and second through holes 70 and, thus, nor the placement of fork 40 to be parallel to the length of base clamp 24. Rather, first and second through holes 70 may be arranged along any portion of annular structure 33.

As noted above and as will be described in more detail below in reference FIG. 7, mounting clamp 26 may have an annular structure which is nestable within annular structure 33 and which further includes an outer circumferential groove. In such configurations, prongs 66 are dimensionally configured to slide through first and second through holes 70 of annular structure 33 and into opposing sides of the outer circumferential groove when base clamp 24 and mounting clamp 26 are engaged. In particular, a span between opposing inner surfaces of prongs 66 may be larger than an outer diameter of the nestable annular structure along its outer circumferential groove. In addition, a span between outer surfaces of prongs 66 may be smaller than an inner diameter of annular structure 33. As a result, fork 40 serves to prevent vertical movement of base clamp 24 relative to mounting clamp 26 and, thus, inhibit loudspeaker 22 from falling. The placement of fork 40 within the annular structures of the base and mounting clamps, however, does not inhibit rotational movement of base clamp 24 and, thus, the clamp and assemblies disclosed herein provide a manner in which to rotate an object while it is in a mounted position.

As noted above, the clamps and assemblies disclosed herein may include a locking screw in addition to fork 40 for securing structure 32 and, thus, loudspeaker 22 in a fixed rotational position relative to mounting clamp 26. More specifically, locking screw 42 may be inserted into a through hole of annular structure 33 and abutted against the nested annular structure of mounting clamp 26 to inhibit movement of base clamp 24 relative to the mounting clamp. In this manner, locking screw 42 may be used to inhibit rotational movement of structure 32 and, thus, loudspeaker 22 as well. As shown FIGS. 3-6, fork 40 may include optional screw hole 68 disposed between prongs 66 and annular structure 33 may include third through hole 72 such that when fork 40 inserted into first and second through holes 70, screw hole 68 is arranged in alignment third through hole 72. Although such a configuration may be beneficial for securing fork 40 within the clamp or assembly, in other embodiments the attachment of locking screw 42 to annular structure 33 may be independent of fork 40. In particular, third through hole 72 may be alternatively disposed at a different location along annular structure 33, such as but not limited to the opposing side of the annular structure relative to the configuration shown in FIGS. 5 and 6. In such cases, screw hole 68 may be omitted from fork 40.

In yet other embodiments, the clamps and assemblies disclosed herein may not include a locking screw and, thus, locking screw 42 may be omitted in some cases. In particular, the clamps and assemblies disclosed herein may, in some embodiments, be configured to mount and/or suspend an object and further allow the object to always be rotatable in such a position. Such a configuration may be facilitated by the use of fork 40 without locking screw 42. In such cases, it may be desirable to secure fork 40 within the clamp or assembly as a safety provision, particularly if the structure to which the clamp or assembly and object is mounted is subject to jarring movement, such as in a boat on or a dune buggy. In particular, jarring movement may cause fork 40 to slip from annular structure 33 and cause the mounted and/or suspended object to fall. As such, in some embodiments, the clamps and assemblies considered herein may include a fastener which secures fork 42 to base clamp 24 but does not inhibit the rotation of base clamp 24 relative to mounting clamp 26. Any type of fastener may be used which is applicable for the design specifications of fork 40 as well as base clamp 24. Examples of fasteners include but are not limited to bolts, screws, and clamps. In yet other cases, fork 40 as well as first and second through holes 70 in annular structure 33 may be omitted from some of the clamps and assemblies disclosed herein. In particular, the clamps and assemblies disclosed herein may include an alternative manner in which to join base clamp 24 and mounting clamp 26, including but not limited to using locking screw 42 absent fork 40.

Figure 7:
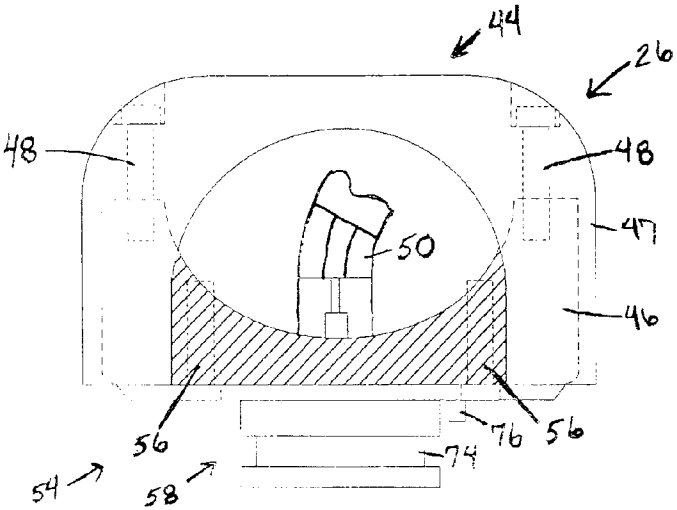
FIG. 7 is a side view drawing of a mounting clamp for the loudspeaker and clamp assembly depicted in FIG. 1.

Turning to FIG. 7, a side view drawing of an assembled mounting clamp 26 is illustrated. As shown in FIG. 7 and described above in reference to FIG. 1, mounting clamp 26 may include tubular mounting unit 44 having screws 48 for fastening upper clamp portion 47 to lower clamp portion 46. In addition, mounting clamp 26 may include detachable mounting plate 54 having screws 56 to affix the mounting plate to lower clamp portion 46 of tubular mounting unit 44 and further having an annular structure 58 which is engageable with annular structure 33 of base clamp 24. Moreover, mounting clamp 26 is shown in FIG. 7 including wires 50 routed through a hole in the bottom of lower clamp portion 46 and coupled to detachable mounting plate 54. The aforementioned components as well as variations thereof are described in detail in reference to FIG. 1, which is not reiterated for the sake of brevity. As shown in FIG. 7, annular structure 58 may include outer circumferential groove 74, which as described above in reference to the use of fork 40 within assembly 20 may be configured to receive at least a portion of prongs 66 of fork 40 when annular structure 58 is nested within annular structure 33. In general, the size, placement and shape of outer circumferential groove 74 may vary and, thus, the clamps and assemblies described herein are not necessarily limited to its depiction in FIG. 7. As further noted in FIG. 7, mounting clamp 26 may, in some embodiments, include rotation stop 76 for mating with rotation stop 66 of base clamp 24 to prevent base clamp 24 and, thus, loudspeaker 22 from turning a full revolution and, in turn, prevent the wires within loudspeaker 22 as well as the wires in the support structure to which the clamp is mounted from twisting.

Figure 8:
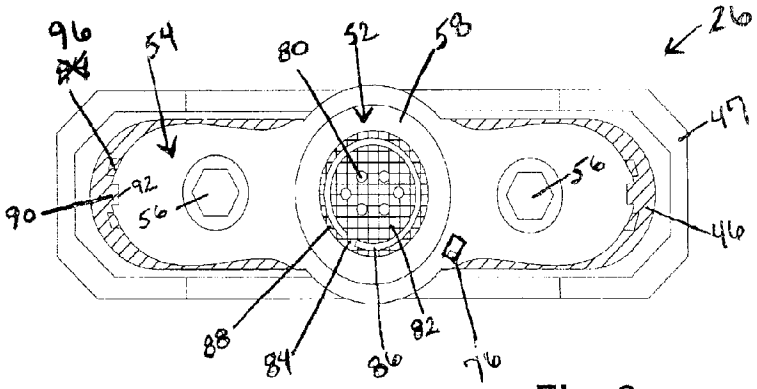
FIG. 8 is a bottom view drawing of the mounting clamp depicted in FIG. 7.

As noted above, mounting clamp 26 may include plug 52 surrounding and/or supporting one or more electrical connectors. A bottom view of mounting clamp 26 is depicted in FIG. 8, detailing an example configuration of plug 52. In particular, FIG. 8 shows plug 52 disposed within annular structure 58 surrounding a plurality of electrical pin receptacles 80, which are configured to receive the plurality of electrical pins 60 of base clamp 24. As noted above in reference to FIG. 2, the number, type and placement of electrical connectors within plug 52 may vary and, thus, mounting clamp 26 is not necessarily limited to the depiction of FIG. 8. In particular, any type of electrical conductor, including electrical pins, electrical pin receptacles, electrical jacks and electrical jack receptacles, may be disposed within plug 52. In addition, any number of electrical connectors, including one or more, may be disposed within plug 52. Furthermore, the placement of electrical connectors within plug 52 may vary depending on design specifications. Thus, the clamps and assemblies disclosed herein are not restricted to the layout of electrical pin receptacles 80 shown in FIG. 8. As further shown in FIG. 8, plug 52 may include cylindrical support structure 82 surrounding electrical pin receptacles 80. Cylindrical support structure 82 may generally be nestable within annular barrier 37*a* of plug 36 in base clamp 24. In this manner, electrical pin receptacles 80 may be engageable with electrical pins 60 of base clamp 24.

As noted above in reference to plug 36, the plugs of base clamp 24 and mounting clamp 26 may have configurations other than those depicted in the drawings and, thus, the clamps and assemblies described herein are not necessarily limited to the depiction of plugs 36 and 52 in FIGS. 2 and 8. As further described above in reference to FIG. 2, the plugs of base clamp 24 and mounting clamp 26 may, in some embodiments, be configured with a self-alignment feature such that the correct counterpart electrical connectors may be quickly aligned for engagement. As shown in FIG. 8, plug 52 includes such a feature for mounting clamp 26 which is compatible with the counterpart feature in plug 36 of base clamp 24. In particular, plug 52 includes protrusion 84 extending from the sidewall of cylindrical support structure 82. As noted above in reference to FIG. 2, protrusion 84 and notch 37*c* of base clamp 24 may be dimensionally configured to receive each other and their relative placement may coincide with counterpart electrical connectors in base clamp 24 and mounting clamp 26. In addition thereto, the tips of electrical pin receptacles 80 may be disposed below the upper surface of annular barrier cylindrical support structure 82. In this manner, when base clamp 24 and mounting clamp 26 are brought together, either or both can be turned until the notch meets the protrusion and then the correct counterpart electrical connectors can engage. As shown in FIG. 8, protrusion 84 may, in some cases, extend out to annular portion 88 forming notch 86 adjacent to cylindrical support structure 80. Notch 86 may generally be dimensioned to receive annular barrier 37*a* of base clamp 24. Such a configuration may further facilitate the engagement of plugs 32 and 52.

Figure 9:
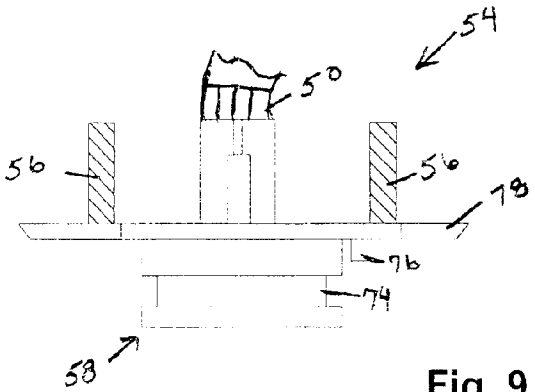
FIG. 9 is a side view drawing of a mounting plate detached from the mounting clamp depicted in FIG. 7.

As noted above, mounting clamp 26 may, in some embodiments, include detachable mounting plate 54. A side view drawing of a configuration of detachable mounting plate 54 detached from tubular mounting unit 44 is provided in FIG. 9. In particular, FIG. 9 illustrates detachable mounting plate 54 detached from the lower surface of lower clamp portion 46 of tubular mounting unit 44. As shown in FIG. 9, detachable mounting plate 54 includes wires 50 and annular structure 58 coupled to opposing sides of the plate. In addition, detachable mounting plate 54 includes a fastener, such as screws 56, for affixing substantially flat surface 78 against a support structure. In this manner, mounting clamp 26 offers two mounting capabilities, specifically being able to mount to a cylindrical support via tubular mounting unit 44 as well as to support structures of other geometries (particularly flat surfaces) via detachable mounting plate 54. As noted above, the clamps and assemblies described herein are not necessarily so limited to having such dual mounting capability. In particular, mounting clamp 26 may not, in some embodiments, include detachable mounting plate 54. Rather, mounting plate 54 may be integral with tubular mounting unit 44 or, conversely, a tubular mounting unit may be omitted from assembly 20.

Figure 10:
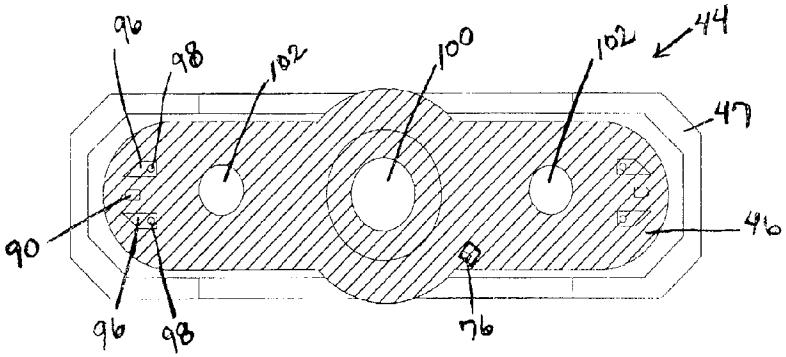
FIG. 10 is a bottom view drawing of a tubular mounting unit detached from the mounting clamp depicted in FIG. 7.

A bottom view drawing of tubular mounting unit 44 having detachable mounting plate 54 detached therefrom is provided in FIG. 10. As shown in FIG. 10, lower clamp portion 46 includes hole 100 through which wires 50 are routed and further includes screw holes 102 for receiving screws 56 when detachable mounting plate 54 is attached. In addition, lower clamp portion 46 includes alignment marker 90 for aligning detachable mounting plate 54 to tubular mounting unit 44. In particular, lower clamp portion 46 may include raised portion delineating alignment marker 90 for aligning with notch 92 of detachable mounting plate 54 (shown in FIG. 8) to ease the joining of detachable mounting plate 54 to tubular mounting unit 44.

As further shown in FIG. 10, lower clamp portion 46 may include recessed portions 96 having drainage holes 98 disposed therein and extending through lower clamp portion 46. In general, drainage holes 98 may be used to remove fluids from lower clamp portion 46 and specifically to keep fluids from collecting around wires 50 and plug 52. Such a configuration may be particularly advantageous in embodiments in which the clamps and assemblies used herein are used in an aquatic environment, such as on boats. Drainage holes 98 extend through lower clamp portion 46 to recessed portions 96, which are configured to route fluid toward the ends of the lower clamp portion to further route fluids away from plug 52. As shown in FIG. 8, detachable mounting clamp 54 may cover a portion of recessed portions 96, particularly the end comprising drainage holes 98. In this manner, recessed portions 96 and detachable mounting clamp 54 may jointly form a channel to route fluid toward the ends of lower clamp portion 46. In general, the size, shape and placement of recessed portions 96 and drainage holes 98 may vary depending on the design specifications of mounting clamp 26 and, thus, their configurations are not necessarily limited to the depictions provided in FIGS. 8 and 10. In some embodiments, however, it may be particularly advantageous to arrange recessed portions 96 and drainage holes 98 near the ends of lower clamp portion 46 in the interest to keep fluids away from wires 50 and plug 52 as much as possible. In other embodiments, recessed portions 96 and/or drainage holes 98 may be omitted from lower clamp portion 46.

Figure 12:
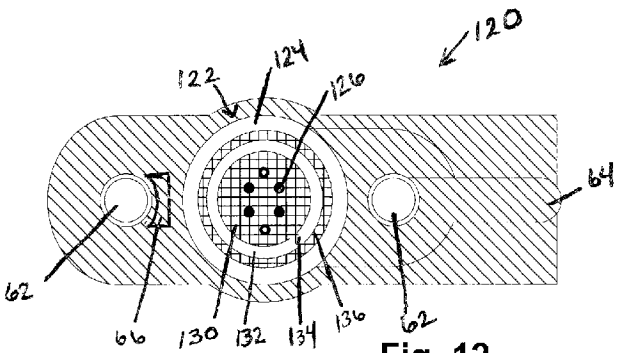
FIG. 12 is a bottom view drawing of an alternative configuration of a base clamp for the loudspeaker and clamp assembly depicted in FIG. 1 which may be used in conjunction with the mounting clamp depicted in FIG. 12.
Figure 11:
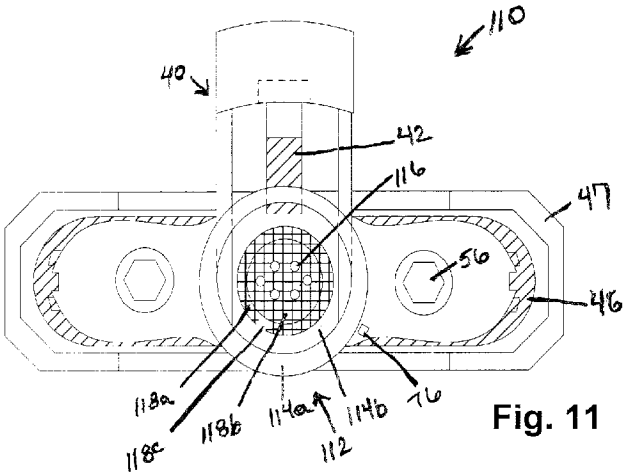
FIG. 11 is a bottom view drawing of an alternative configuration of a mounting clamp joined with a fork and a screw for the loudspeaker and clamp assembly depicted in FIG. 1.

As noted above, the annular structures of base clamp 24 and mounting clamp 26 are engageable and, more specifically, one of the annular structures is nestable within the other encircling annular structure. The descriptions of base clamp 24 and mounting clamp 26 above in reference to FIGS. 1-10 concentrate on embodiments in which base clamp 24 includes an encircling annular structure and mounting clamp includes a nestable annular structure, but the clamps and assemblies described herein are not necessarily so limited. In particular, base clamp 24 and mounting clamp 26 may include reverse configurations with respect to their annular structures such that base clamp 24 includes a nestable annular structure and mounting clamp 26 includes an encircling annular structure. FIGS. 11 and 12 respectively illustrate embodiments of a mounting clamp and a base clamp with such alternative configurations for their annular structures. In particular, FIG. 11 depicts a bottom view of mounting clamp 110 having annular structure 112, which encircles annular structure 124 of base clamp 120 depicted in FIG. 12.

As shown in FIG. 11, mounting clamp 110 may include some of the same features as described for mounting clamp 26 and base clamp 24 in reference to FIGS. 2-10. Features with the same configurations as previously described are denoted with the same references number and the descriptions of such features are not reiterated for the sake of brevity. As shown in FIG. 11, annular structure 112 includes annular wall 114*a* and recessed inner portion 114*b*. In some embodiments, mounting clamp 110 may include a bushing lining annular structure 112, but such inclusion is optional. As noted above, annular structure 112 may be configured to encircle annular structure 124 of base clamp 120 depicted in FIG. 12. In particular, annular structure 112 has a larger inner diameter than the outer diameter of annular structure 124. Furthermore, annular structures 112 and 122 may be fully or nearly fully engageable and, thus, their wall heights may be similar.

FIG. 11 further shows mounting clamp 110 including a plug disposed within annular structure 112, surrounding and supporting a plurality of electrical pin receptacles 116. In general, the number, type and placement of electrical connectors within the plug may vary and, thus, mounting clamp 110 is not necessarily limited to the depiction of FIG. 11. In particular, any type of electrical conductor, including electrical pins, electrical pin receptacles, electrical jacks and electrical jack receptacles, may be disposed within the plug of mounting clamp 110. In addition, any number of electrical connectors, including one or more, may be disposed within the plug. Furthermore, the placement of electrical connectors within the plug may vary depending on design specifications. As shown in FIG. 11, the plug may include annular barrier 118*a* and recessed inner portion 118*b* and, in some embodiments, may include notch 118*c* within annular barrier 118*a* to offer a self-alignment feature with the plug disposed within base clamp 20 depicted in FIG. 12. In any case, since annular structure 112 is an encircling annular structure relative to annular structure 124 of base clamp 120 depicted in FIG. 12, fork 40 and/or locking screw 42 may be inserted into mounting clamp 110 rather than base clamp 120 (which is opposite to the configuration set forth in the description for FIGS. 1-10). As in base clamp 24, the insertion of fork 40 and locking screw 42 may generally be facilitated via through holes in the sidewalls of annular structure 112. The though holes provided in annular structure 112 may be similar to through holes 70 and 72 discussed in reference to FIG. 5 and a detailed description of such is not repeated for the sake of brevity. It is noted that placement of fork 40 may vary and, thus, is not restricted to be perpendicular to the length of mounting clamp 110.

Turning to FIG. 12, a bottom view drawing of base clamp 120 is provided. As with FIG. 11, features with the same configurations as previously described are denoted with the same references number in FIG. 12 and the descriptions of such features are not reiterated for the sake of brevity. FIG. 12 illustrates base clamp 120 including annular structure 124 which is nestable within annular structure 112 of mounting clamp 110 depicted in FIG. 11. In particular, annular structure 124 has a smaller outer diameter than the inner diameter of annular structure 112. As further shown in FIG. 12, annular structure 124 encircles plug 122 and specifically electrical pins 126. As with the configuration of mounting clamp 110, the number, type and placement of electrical connectors within plug 122 may vary and, thus, base clamp 120 is not necessarily limited to the depiction of FIG. 12. FIG. 12 illustrates plug 122 having cylindrical support structure 130 surrounding electrical pins 126. Cylindrical support structure 130 may generally be nestable within annular barrier 118*a* of mounting clamp 110 depicted in FIG. 11. In this manner, electrical pins 126 may be engageable with electrical pin receptacles 116. In some embodiments, plug 122 may include protrusion 134 extending from cylindrical support structure 130 and configured to mate with notch 118*c* of mounting clamp 110 depicted in FIG. 11 to provide a self-alignment feature to the electrical connectors of the clamps. As shown in FIG. 12, protrusion 134 may, in some cases, extend out to annular portion 136 forming notch 132 adjacent to cylindrical support structure 130. Notch 132 may generally be dimensioned to receive annular barrier 118*a* of base clamp 110 to further facilitate the engagement of the plugs for the clamps.

It will be appreciated to those skilled in the art having the benefit of this disclosure that this invention is believed to provide mountable loudspeaker assemblies and clamps. Further modifications and alternative embodiments of various aspects of the invention will be apparent to those skilled in the art in view of this description. For example, the clamps and assemblies described herein are not necessarily restricted to those configured to mount and/or suspend loudspeakers. In particular, one or more of the features described herein may be applied to clamps and assemblies for mounting and/or suspending various types of objects. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. An assembly, comprising:

a loudspeaker;

a base clamp comprising:

a first plurality of electrical connectors in electrical communication with signal transmission wires of the loudspeaker; and a first clamp structure surrounding the first plurality of electrical connectors and coupled to the loudspeaker; and a mounting clamp comprising:

a second plurality of electrical connectors engageable with the first plurality of electrical connectors, wherein either the first plurality of electrical connectors or second plurality of electrical connectors are electrical pins, and wherein the other of the first and second plurality of electrical connectors are electrical pin receptacles configured to receive the electrical pins; and a second clamp structure surrounding the second plurality of electrical connectors, wherein the assembly comprises a means to rotate the first clamp structure relative to the second clamp structure when the first and second plurality of electrical connectors are engaged.

2. The assembly of claim 1, wherein the first plurality of electrical connectors are part of a first electrical connector assembly which is rotatably arranged within the first clamp structure, and wherein the second plurality of electrical connectors are part of a second electrical connector assembly which is fixedly arranged with the second clamp structure.

3. The assembly of claim 1, wherein the first plurality of electrical connectors are part of a first electrical connector assembly which is fixedly arranged within the first clamp structure, and wherein the second plurality of electrical connectors are part of a second electrical connector assembly which is rotatably arranged with the second clamp structure.

4. The assembly of claim 1, wherein the first and second clamp structures each comprise a rotation stop configured to come into contact with each other when the first and second plurality of electrical connectors are engaged and the first clamp structure is being rotated.

5. The assembly of claim 1, wherein the first and second plurality of electrical connectors comprise an engageable pair of electrical connectors for audio signal transmission and another engageable pair of electrical connectors for ground connection.

6. The assembly of claim 5, wherein the first and second plurality of electrical connectors further comprise an engageable pair of electrical connectors for light signal transmission.

7. The assembly of claim 6, wherein the first and second plurality of electrical connectors comprise multiple engageable pairs of electrical connectors for light signal transmission, and wherein each of the multiple engageable pairs of electrical connectors for light signal transmission are for respectively different colors of light.

8. The assembly of claim 1, wherein the electrical pins are part of an electrical pin assembly which further comprises an annular barrier surrounding the electrical pins, wherein the electrical pin receptacles are part of an electrical pin receptacle assembly which further comprises a cylindrical support structure surrounding the electrical pin receptacles, wherein the cylindrical support structure is nestable within the annular barrier, and wherein the annular barrier comprises a notch which is configured to received a protrusion arranged along the cylindrical support structure.

9. An assembly, comprising:

a loudspeaker;

a base clamp coupled to the loudspeaker, wherein the base clamp comprises a first electrical connector in electrical communication with signal transmission wires of the loudspeaker;

a mounting clamp comprising a second electrical connector engageable with the first electrical connector, wherein the base clamp and the mounting clamp each comprise an annular sidewall surrounding the respective first and second electrical connectors, wherein one of the annular sidewalls is nestable within the other encircling annular sidewall, wherein the nestable annular sidewall comprises an outer circumferential groove, and wherein the encircling annular sidewall comprises:

first and second through holes arranged along the circling annular sidewall such that the first and second through holes are aligned with opposing sides of the outer circumferential groove of the nestable annular sidewall when the annular sidewalk are nested; and a threaded third through hole arranged along the encircling annular sidewall such that the threaded third through hole exposes a portion of the nestable annular sidewall when the first and second through holes are aligned with opposing sides of the outer circumferential groove of the nestable annular sidewall;

a fork comprising two prongs dimensionally configured to slide through the first and second through holes and into the opposing sides of the outer circumferential groove when the first and second through holes are aligned with opposing sides of the outer circumferential groove of the nestable annular sidewall; and a locking screw dimensionally configured to fit through the threaded third through hole of the encircling annular sidewall and abut against the exposed portion of the nested annular sidewall.

10. The assembly of claim 9, wherein the fork comprises a threaded screw hole between the two prongs, wherein the threaded third through hole of the encircling annular sidewall is arranged between the first and second through holes such that when the two prongs are inserted into the first and second through holes the threaded screw hole is arranged in alignment with the threaded third through hole, and wherein the locking screw is configured to additionally fit through the threaded screw hole.

11. The assembly of claim 9, wherein the two prongs and the first and second through holes are dimensionally configured such that distal ends of the two prongs can touch an interior surface of the encircling annular sidewall when the two prongs are inserted into the first and second through holes.

12. The assembly of claim 9, wherein the base clamp comprises the encircling annular sidewall.

13. The assembly of claim 9, wherein the mounting clamp comprises the encircling annular sidewall.

14. The assembly of claim 9, wherein a span between outer surfaces of the two prongs is shorter than an inner diameter of the encircling annular sidewall.

15. A clamp for mounting a speaker, wherein the clamp comprises:

a base sub-clamp;

a fastener for affixing the base sub-clamp to a speaker which has audio and light signal transmission wires; and a mounting sub-clamp engageable with the base sub-clamp, wherein the base sub-clamp and the mounting sub-clamp each comprise a first electrical contact for audio signal transmission, a second electrical contact for ground connection, and a third electrical contact for light signal transmission, wherein the first, second and third electrical contacts of either of the base sub-clamp or the mounting sub-clamp are electrical pins, and wherein the first, second and third electrical contacts of the other sub-clamp are electrical pin receptacles configured to receive the electrical pins.

16. The clamp of claim 15, wherein the base sub-clamp and the mounting sub-clamp each comprise multiple electrical contacts for light signal transmission, and wherein each of the multiple electrical contacts are for respectively different colors of light.

17. The clamp of claim 15, wherein the mounting sub-clamp comprises:

a tubular mounting unit; and a fastener for affixing the tubular mounting unit around a cylindrical object.

18. The clamp of claim 17, wherein the tubular mounting unit comprises drainage holes within its bottom portion.

19. The clamp of claim 15, wherein the mounting sub-clamp comprises:

a mounting plate having a substantially flat surface; and a fastener for affixing the substantially flat surface against a support structure.

20. The clamp of claim 19, wherein the mounting sub-clamp further comprises:

a tubular mounting unit;

a fastener for affixing the tubular mounting unit around a cylindrical object; and a means for affixing the mounting plate to the tubular mounting unit, wherein the mounting plate and tubular mounting unit comprise alignment markers for joining.

* * * * *

UNITED STATES PATENT AND TRADEMARK OFFICE

CERTIFICATE OF CORRECTION

PATENT NO. : 8,568,162 B1
APPLICATION NO. : 13/108376
DATED : October 29, 2013
INVENTOR(S) : White et al.

It is certified that error appears in the above-identified patent and that said Letters Patent is hereby corrected as shown below:

IN THE CLAIMS:

Claim 9, col. 17, line 16: replace the word “circling” with “encircling”

Claim 9, col. 17, line 20: replace the word “sidewalk” with “sidewalls”

Signed and Sealed this
Eighteenth Day of March, 2014

Michelle K. Lee

Michelle K. Lee
*Deputy Director of the United States Patent and Trademark Office*